US011430349B2

(12) United States Patent
Mazzone

(10) Patent No.: US 11,430,349 B2
(45) Date of Patent: Aug. 30, 2022

(54) APPARATUS FOR MOUNTING ELECTRONIC SHELF LABELS

(71) Applicant: MAZZONE INVESTMENTS INC., Montreal (CA)

(72) Inventor: Diego Mazzone, Montreal (CA)

(73) Assignee: Mazzone Investments Inc.

( * ) Notice: Subject to any disclaimer, the term of this patent is extended or adjusted under 35 U.S.C. 154(b) by 0 days.

(21) Appl. No.: 16/863,447

(22) Filed: Apr. 30, 2020

(65) Prior Publication Data

US 2021/0343193 A1 Nov. 4, 2021

(51) Int. Cl.
*G09F 3/20* (2006.01)
*A47F 5/08* (2006.01)

(52) U.S. Cl.
CPC ..... *G09F 3/204* (2013.01); *A47F 5/0869* (2013.01); *G09F 3/208* (2013.01)

(58) Field of Classification Search
CPC ..... A47F 5/0869; G09F 3/204; G09F 3/208
USPC ..... 40/661.03; D20/42–44
See application file for complete search history.

(56) References Cited

U.S. PATENT DOCUMENTS 4,426,797 A * 1/1984 Burkemper ..... G09F 3/20 40/584
4,532,726 A * 8/1985 Kenney ..... G09F 3/20 40/650
5,899,011 A * 5/1999 Brinkman ..... G09F 3/204 248/231.81
6,105,295 A * 8/2000 Brinkman ..... G09F 3/204 248/214
6,553,702 B1 * 4/2003 Bacnik ..... G09F 3/204 40/649
6,688,567 B2 * 2/2004 Fast ..... G09F 3/204 211/57.1
6,935,062 B2 * 8/2005 Lowry ..... G03B 21/00 248/205.1
2002/0146282 A1 * 10/2002 Wilkes ..... A47F 5/0068 403/331
2005/0166438 A1 * 8/2005 Mueller ..... G09F 3/204 40/661.03

FOREIGN PATENT DOCUMENTS

CA 3079881 A1 * 10/2021
DE 202011107543 U1 * 2/2012 ..... G09F 3/204

* cited by examiner

*Primary Examiner* — Cassandra Davis
(74) *Attorney, Agent, or Firm* — Miller Thomson LLP

(57) ABSTRACT

There is disclosed an apparatus for mounting electronic shelf labels (ESLs) onto shelving, comprising: a rail having first and second grasping members adapted to receive one or more ESLs; and an installation clip integrally connected to the rail, the installation clip adapted to install the apparatus onto shelving in a plurality of configurations by either clipping onto a curved front face of shelving or snapping into a curved front face of shelving. In an embodiment, the installation clip comprises an inner wall and an outer wall flexibly joined at a knee, the inner and outer walls being resiliently flexible relative to each other and having an opening adapted to receive a front face of shelving therebetween. In another embodiment, locking features provided on the out wall allow the apparatus to be snapped into position onto a curved face of shelving having top and bottom extending ledges.

12 Claims, 12 Drawing Sheets

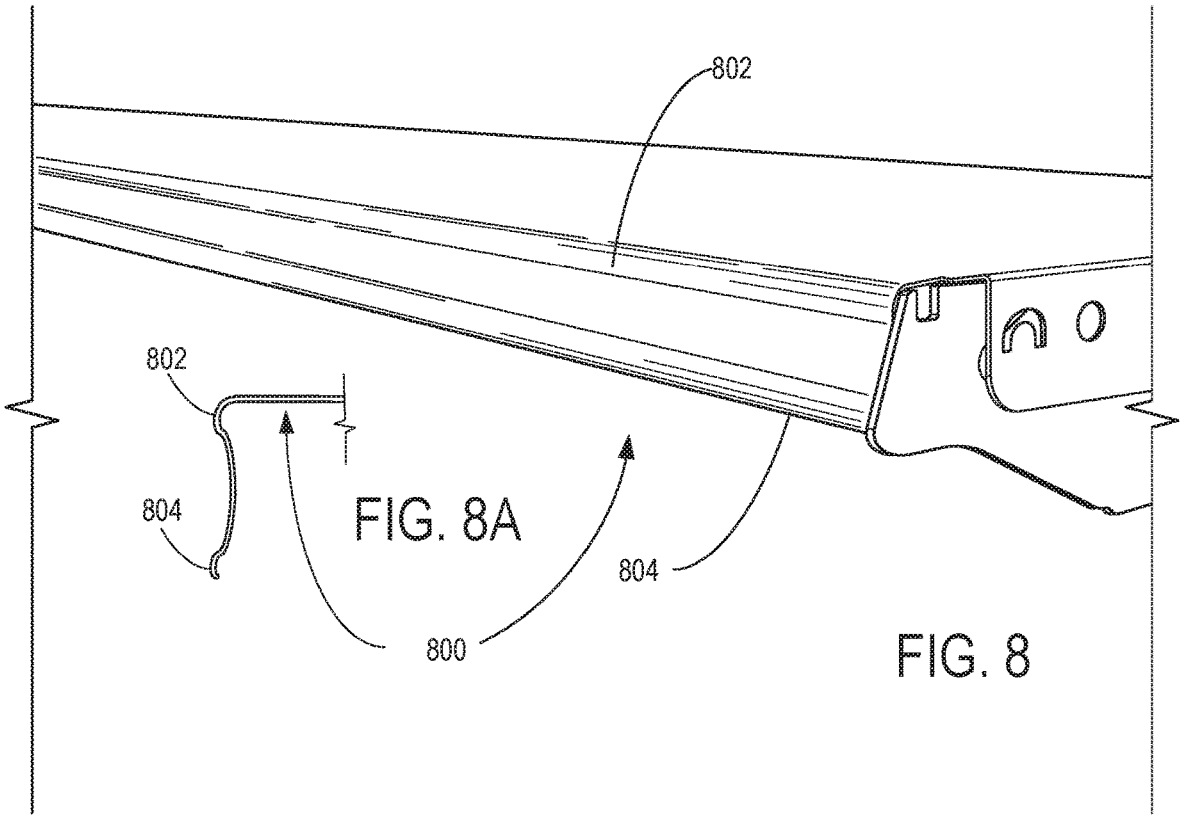
FIG. 8A
FIG. 8
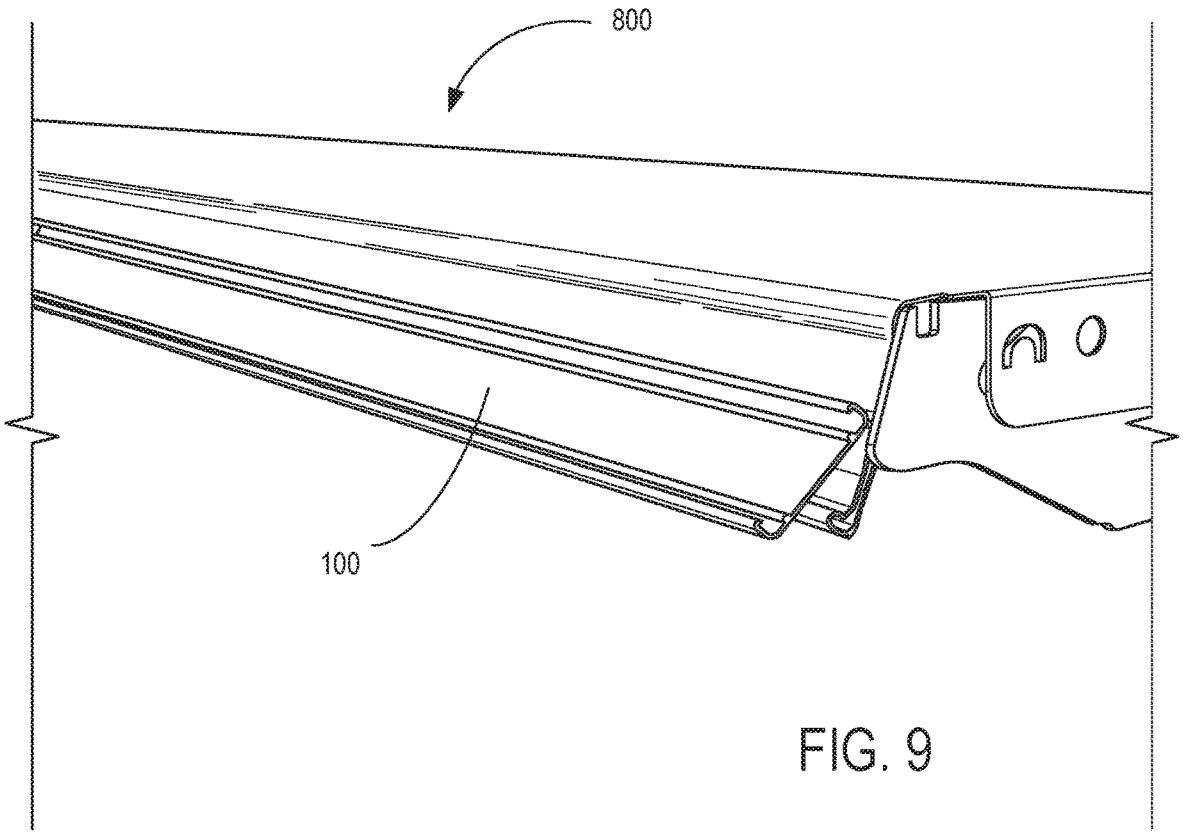
FIG. 9

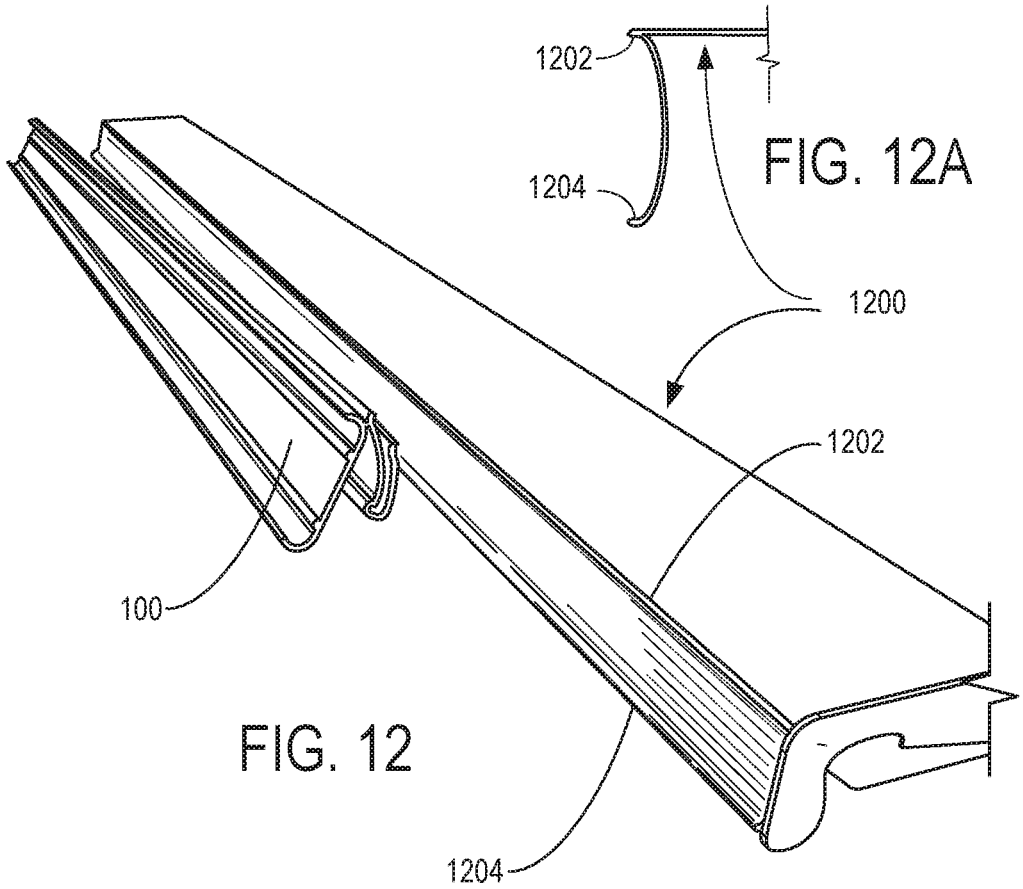
FIG. 12A
FIG. 12
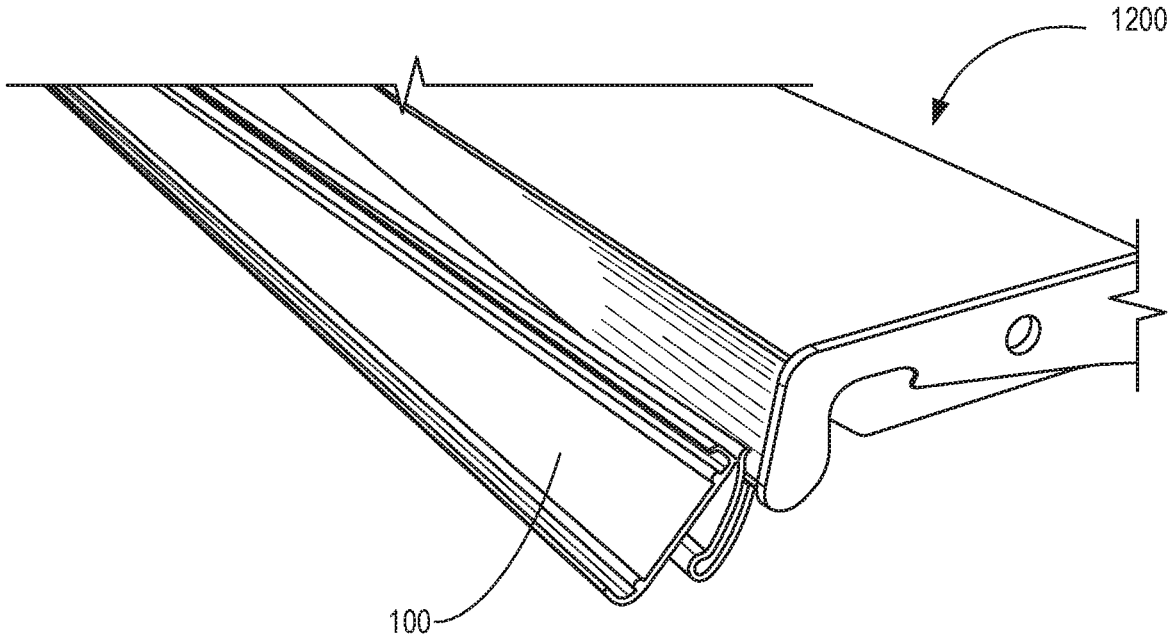
FIG. 13

APPARATUS FOR MOUNTING ELECTRONIC SHELF LABELS

FIELD OF THE INVENTION

The present disclosure relates to an apparatus for mounting shelf labels, and more particularly an apparatus for mounting digital price tags or electronic shelf labels (ESLs) onto shelving used in retail environments.

BACKGROUND

Digital price tags or electronic shelf labels (referred to as "ESLs" in this disclosure) are used by retailers—such as grocery stores, pharmacies and hardware stores, etc.—to display digital pricing information on the front face of shelves stocked with various consumer items corresponding to the ESLs. They can also be used in other industries such as logistics and warehousing to display pertinent information regarding the products on the shelves (e.g. inventory) for employees working within these industries. These ESLs are convenient and very flexible alternatives to traditional printed labels as they can be quickly and automatically changed to reflect updated pricing information—for example due to a price increase, or a temporary discount reflecting a sale for certain items.

While convenient, ESLs typically require a mounting solution to attach to conventional shelving. In North America, popular types of shelving include bent metal sheet shelving having a concave C-channel shaped front face. Some types of shelving have an extending ledge at both the top and bottom of the C-channel front face, while others have only a single ledge at the bottom of the C-channel. Other shelving may have no ledges on the C-channel at all. Two popular types of retail shelving include smooth C-channel Gondola Shelves (i.e. no upper or lower ledges) manufactured by Équipement Boni, and traditional C-Channel Gondola Shelves having distinct upper and lower ledges manufactured by companies like Lozier Corporation, Vic Store Fixtures, Etalex, Madix and others.

As shelves manufactured by different shelf manufacturers are shaped differently, different ESL mounting solutions have been developed, one for each shelving type. However, requiring multiple mounting solutions for different types of shelving can be very inconvenient and time consuming, especially when mounting ESLs in a retail environment having various different types of shelving throughout a large retail space. In addition, there typically is a variant for each of the shelves at the top of a shelving gondola, typically referred to as a "top-shelf" solution. This top-shelf variant is typically extruded with a downward angle for viewing of prices from below.

Therefore, what is needed is an improved apparatus for mounting ESLs on retail shelving which addresses at least some of these limitations.

SUMMARY

The present disclosure relates generally to an apparatus for mounting electronic shelf labels or ESLs to a different types of commonly found retail shelving.

In an aspect, the ESL mounting apparatus comprises a rail having a versatile installation clip attached thereto. The installation clip allows the ESL mounting apparatus to be installed onto various types of retail shelving in multiple configurations.

The rail and installation clip may be formed as an integral unit, for example by extrusion. In a preferred embodiment, the ESL mounting apparatus is extruded from a resiliently flexible material such as Polyvinyl chloride (PVC) plastic, for example, which provides sufficient rigidity, resilience and flexibility for securely positioning the ESL mounting apparatus to a front face of shelving, and for receiving a plurality of ESLs within the rail of the ESL mounting apparatus.

Certain features of the ESL mounting apparatus may be co-extruded using a different material, such as a softer plastic, to provide features having varying rigidity, flexibility, or sliding resistance.

In an embodiment, the rail of the ESL mounting apparatus has first and second grasping members for grasping a top-end and a bottom-end of the ESLs, respectively.

In another embodiment, the first and second grasping members of the rail can grasp a bottom-end and top-end of the ESLs, respectively, if the ESL mounting apparatus is installed in an upside-down configuration for use on higher shelving.

In either orientation, the first and second grasping members of the rail grasp ESLs snapped into position with sufficient force to prevent manual removal of ESLs from the rail without a removal tool. A suitable removal tool when inserted along the top of a mounted ESL temporarily provides sufficient leverage to lift one of the first and second grasping members to allow the ESL to be removed from the rail.

Preferably, while preventing unauthorized removal of ESLs, the rail of the ESL mounting apparatus also allows the ESLs to be slidably adjusted, with moderate resistance, along its length to allow for flexibility in stocking and moving various consumer items on the shelving without having to remove the ESLs altogether.

In a preferred embodiment, the installation clip allows the ESL mounting apparatus to be installed on shelving in at least two orientations: In a first orientation, the installation clip includes an opening to receive a front face of shelving, and to keep the ESL mounting apparatus securely installed to the shelving with a locking feature; In a second orientation, the installation clip includes first and second edges which allow the ESL mounting apparatus to be snapped into position within a C-channel formed by the front of shelving, with the first and second edges locking the ESL mounting apparatus in position.

Advantageously, by providing the ESL mounting apparatus with a versatile, integral installation clip, there is no need to provide multiple ESL mounting solutions for different types of retail shelving.

In this respect, before explaining at least one embodiment of the invention in detail, it is to be understood that the invention is not limited in its application to the details of construction and to the arrangements of the components set forth in the following description or the examples provided therein, or illustrated in the drawings. Therefore, it will be appreciated that a number of variants and modifications can be made without departing from the teachings of the disclosure as a whole.

Therefore, the invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The present invention will be better understood, and objects of the invention will become apparent, when consideration is given to the following detailed description thereof. Such description makes reference to the annexed drawings, wherein:

FIG. 8 shows a type of shelving, having a curved top front edge and a bottom ledge formed by an extending protrusion.

FIG. 8A shows an illustrative profile formed by the front face of the shelving of FIG. 8.

FIG. 9 shows the ESL mounting apparatus of FIGS. 1-7 in position to be installed on the front face of the shelving of FIG. 8.

FIG. 12 shows the ESL mounting apparatus of FIGS. 1-7 and another type of shelving having an overhanging ledge at its top front face to form a C-channel having both top and bottom ledges.

FIG. 12A shows an illustrative profile view of the front face if the shelving of FIG. 12.

FIG. 13 shows the ESL mounting apparatus of FIGS. 1-7 positioned to be installed onto the type of shelving of FIG. 12.

Figure 1:
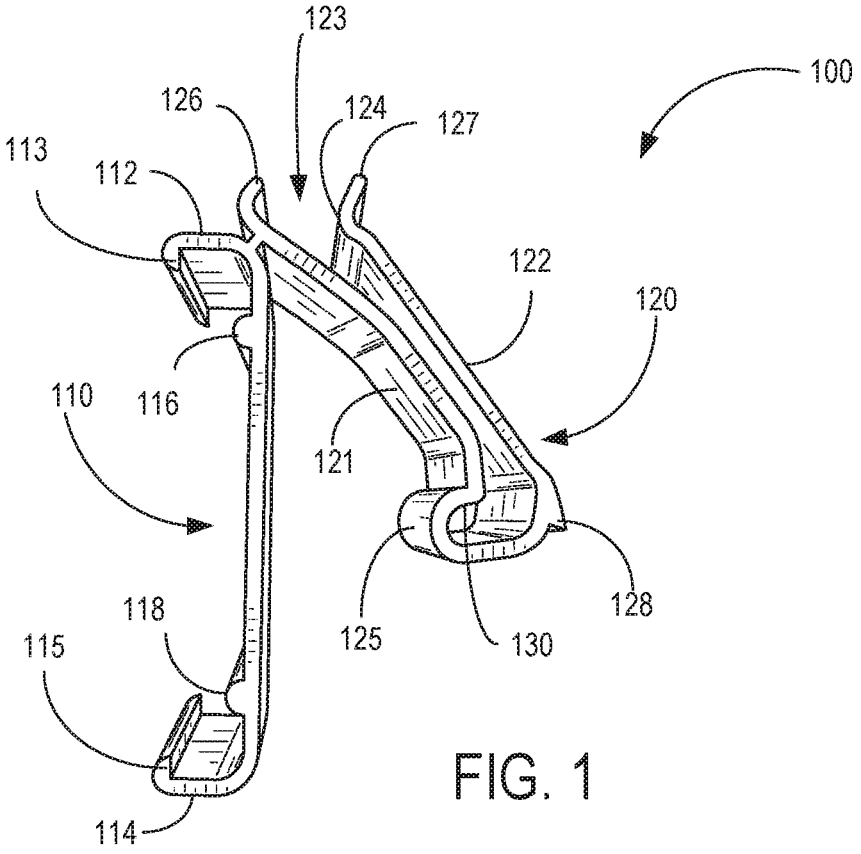
FIG. 1 shows an end profile view of an ESL mounting apparatus for mounting ESLs in accordance with an illustrative embodiment.
Figure 2:
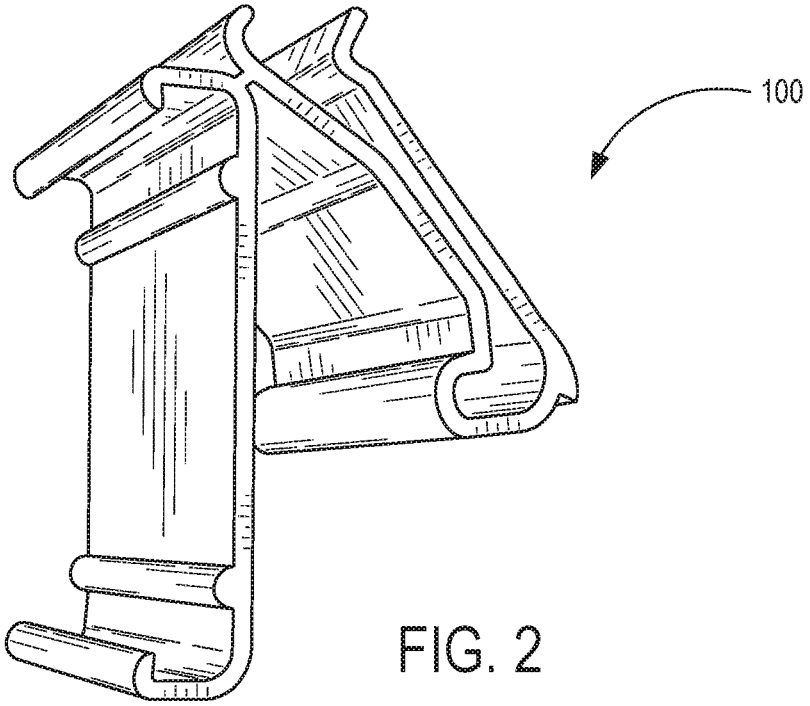
FIGS. 2-7 show a representative small section of the ESL mounting apparatus of FIG. 1 to show the shape of the rail apparatus from different points of view.
Figure 3:
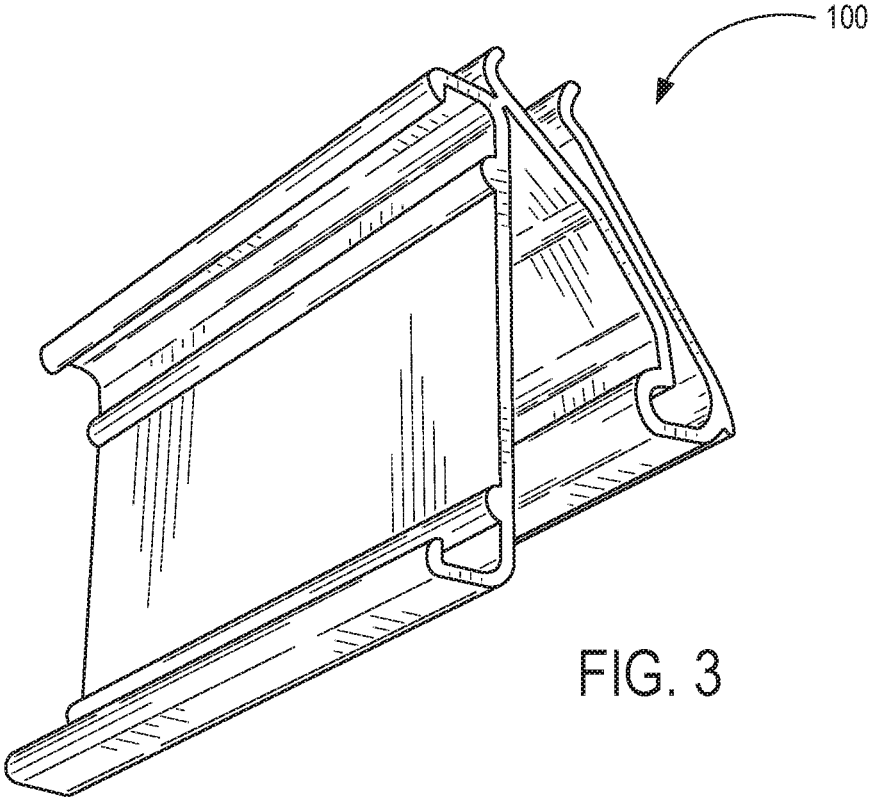
Figure 4:
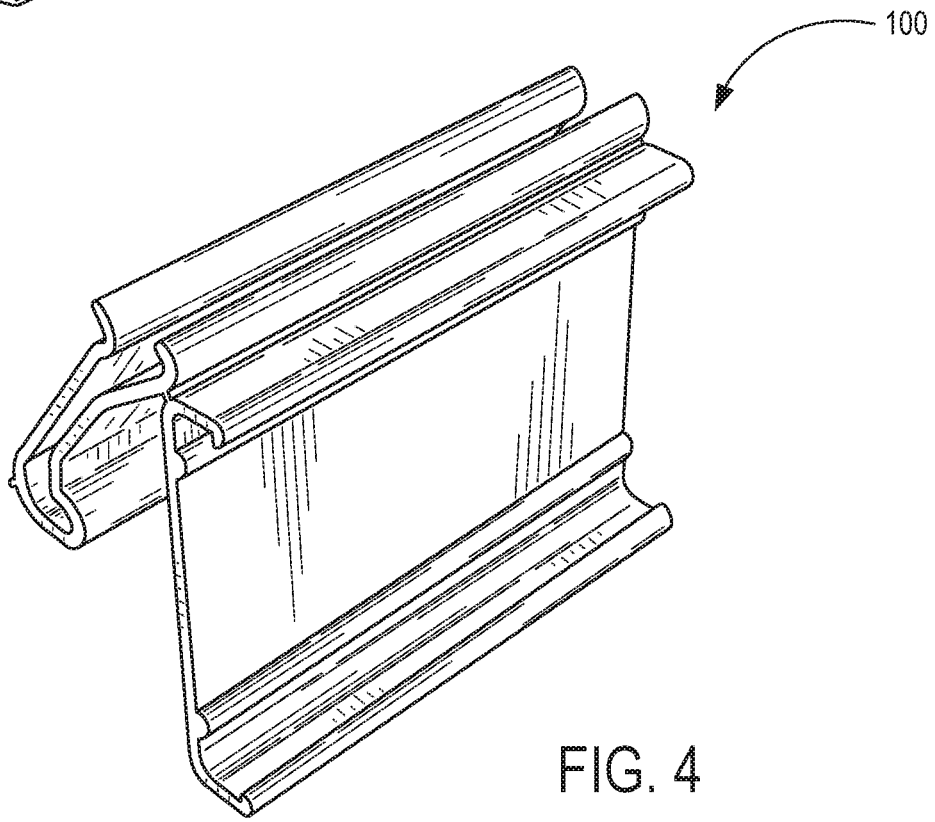
Figure 5:
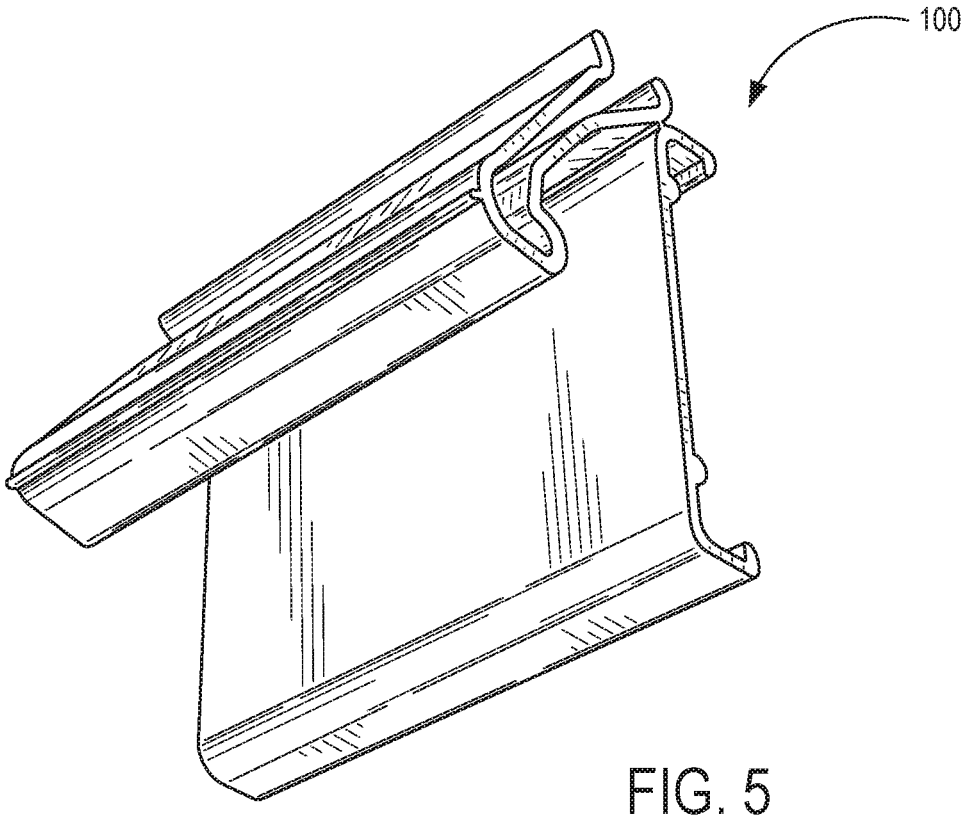
Figure 6:
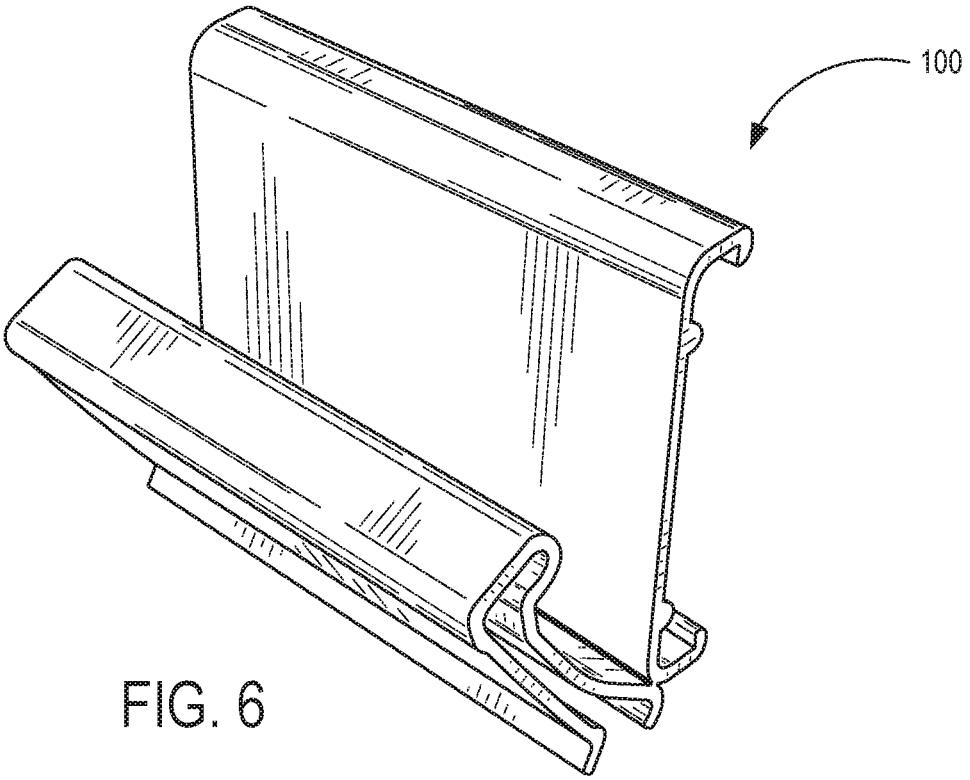
Figure 7:
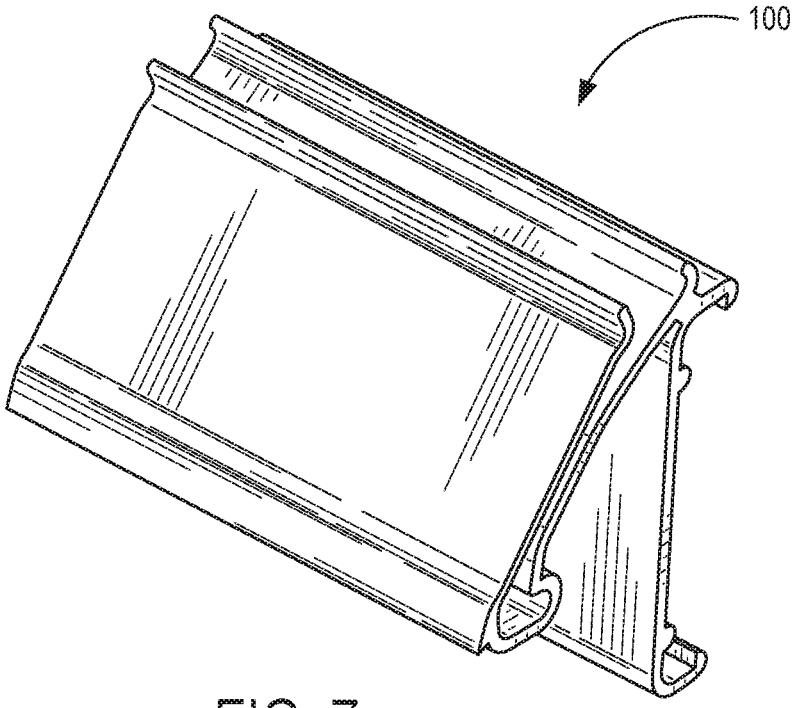

In the drawings, embodiments are illustrated by way of example. It is to be expressly understood that the description and drawings are only for the purpose of illustration and as an aid to understanding, and are not intended as describing the accurate performance and behavior of the embodiments and a definition of the limits of the invention.

DETAILED DESCRIPTION

As noted above, the present invention relates to an apparatus for mounting electronic shelf labels or ESLs to a variety of different types of shelving.

Referring to FIGS. 1-7, in an illustrative embodiment, ESL mounting apparatus 100 comprises a rail 110 having an installation clip 120 attached thereto. The rail 110 and installation clip 120 may be formed as an integral unit, for example by extrusion. While an illustrative short length of the ESL mounting apparatus 100 is shown, it will be understood that the length of the ESL mounting apparatus 100 may be cut to an appropriate length to be installed on the front face of shelving as may be required, and therefore may be significantly longer than this illustrative example (see FIGS. 9-21, for example).

In a preferred embodiment, the ESL mounting apparatus 100 is extruded from a resiliently flexible material such as Polyvinyl chloride (PVC) plastic. This plastic material provides sufficient rigidity, resilience and flexibility for securely positioning the ESL mounting apparatus 100 to a front face of shelving using the installation clip 120, and for receiving ESLs within the rail 110 of the ESL mounting apparatus 100.

Still referring to FIGS. 1-7, in an embodiment, rail 110 forms a shallow channel with first and second sides 112, 114 having first and second grasping members 113, 115 respectively. Rail 110 may also include first and second protrusions 116, 118 for providing contact points for any ESLs mounted within rail 110 to make sliding adjustments easier or harder (for example, see FIGS. 1-22 further below).

In an embodiment, first and second protrusions 116, 118 may be co-extruded using a softer plastic material in order to provide greater sliding resistance, and by be built up or built down to provide less or more sliding resistance.

Still referring to FIGS. 1-7, installation clip 120 has an opening 123 formed by an inner wall 121 and an outer wall 122 having lips 126 and 127 defining either side of opening 123. The inner wall 121 and outside 122 of installation clip 120 are joined at an opposite end of the opening 123 at a resiliently flexible knee 125. The inside of knee 125 forms a locking feature 130 which allows a lower ledge of a front face of a shelving (e.g. lower curve 804 of shelving 800 of FIG. 8, or lower ledge 1204 of shelving 1200 of FIG. 12) to be secured into position within the locking feature 130. In this illustrative example, the locking feature 130 forms a pocket shelf into which a lower curve 804 or a lower ledge 1204 of shelving engages. The inner wall 121 and outer wall 122 of installation clip 120 thus securely holds onto the front face of shelving received within the opening 123.

In an embodiment, lip 127 of the outer wall 122 of installation clip 120 is curved outwardly to form a first locking edge at its outermost tip. A second locking edge 128 is formed near an opposite end of the outer wall 122 to allow the outer wall 122 of installation clip 120 to be received within a C-channel of certain types of shelving, as will be described in more detail further below.

Now referring to FIG. 8, shown is a type of shelving 800 having a curved front face with a curved top edge 802, and a curved bottom edge 804 formed along its bottom. FIG. 8A provides an illustrative profile view of the curved front face of shelving 800.

FIG. 9 shows the ESL mounting apparatus 100 in position to be installed on the front face of the shelving 800 of FIG. 8 by receiving the curved bottom edge 804 of shelving 800 into the opening 123 of installation clip 120. The inner and outer walls 121 and 122 of the installation clip are resiliently flexible in relation to each other, and grasp the curved front face of shelving 800 therebetween. Furthermore, the curved lip 126 engages over the curved top edge 802 of shelving 800 as a complimentary bump 124 of curved lip 127 applies counter-pressure against the curved lip 126 from the other side of the front face of shelving 800.

Figure 10:
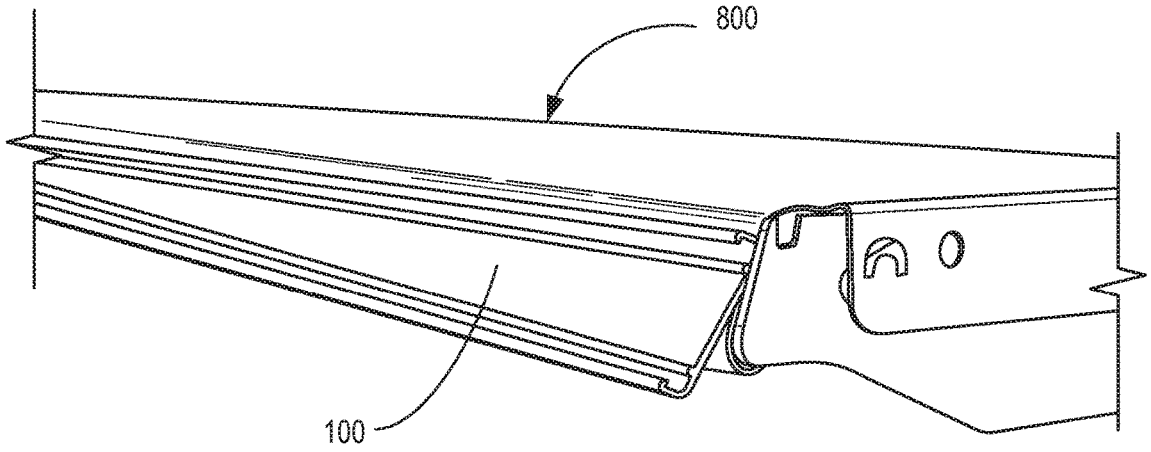
FIG. 10 shows the ESL mounting apparatus of FIGS. 1-7 being further installed on to the front face of the shelving of FIG. 8.

FIG. 10 shows the ESL mounting apparatus 100 being progressively installed further onto the C-channel front face of the shelving 800 of FIG. 8, until the C-channel front face of the shelving is fully seated within the opening 123 of installation clip 120, and held in position by the features of the installation clip 120 as described above.

Figure 11:
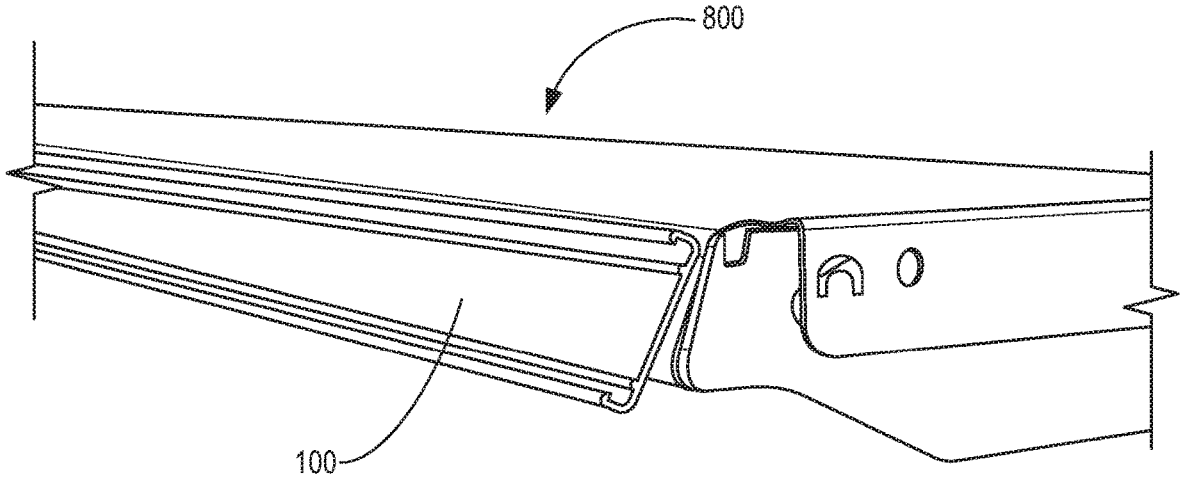
FIG. 11 shows the ESL mounting apparatus of FIGS. 1-7 fully installed on to the front face of the shelving of FIG. 8.

FIG. 11 shows the ESL mounting apparatus 100 fully installed on to the front face of the shelving 800 of FIG. 8. Once the front face of retail shelving 800 is fully seated between the inner and outer walls 121, 122 of the installation clip, the ESL mounting apparatus 100 securely stays in position on the front face of retail shelving 800, unless it is removed with some significant force.

Now referring to FIG. 12, shown is the ESL mounting apparatus 100 and another type of retail shelving 1200 having a concave C-channel front face with a distinct overhanging ledge 1202 at its top front edge and another distinct bottom ledge 1204 running along its bottom. As illustrated in FIG. 12A, the overhanging top ledge 1202 and bottom ledge 1204 form a C-channel having top and bottom ledges 1202 and 1204.

FIG. 13 shows the ESL mounting apparatus 100 positioned to be installed onto shelving 1200 of FIG. 12 by receiving the front face of shelving 1200 between the inner and outer walls 121, 122 of the installation clip 120.

Figure 14:
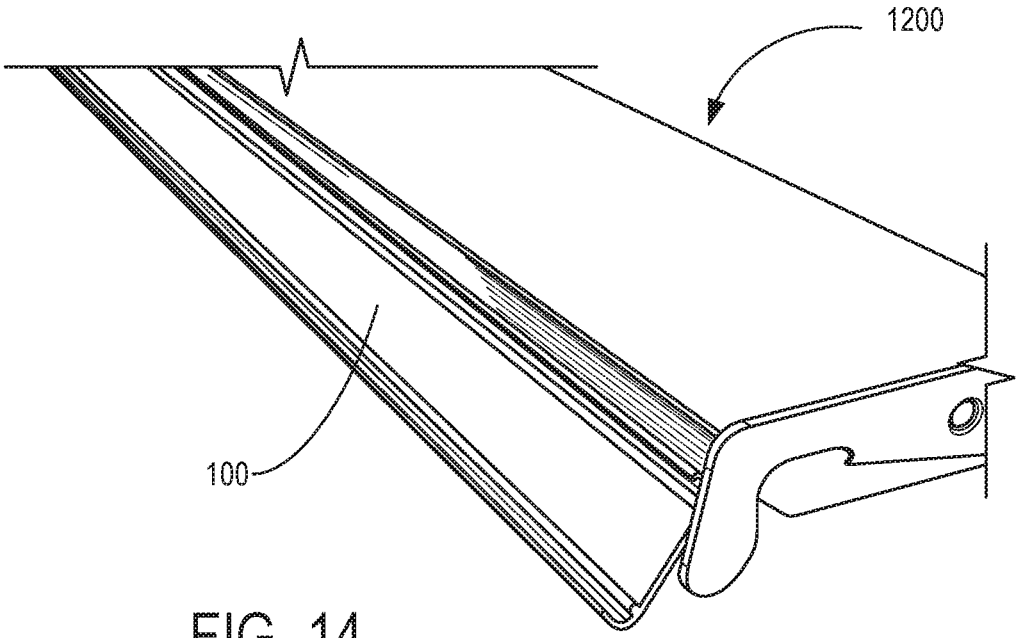
FIG. 14 shows the ESL mounting apparatus of FIGS. 1-7 further installed onto the type of shelving of FIG. 12.

FIG. 14 shows the ESL mounting apparatus 100 further installed onto the shelving 1200 of FIG. 12. When fully installed, bottom ledge 1204 of shelving 1200 will be fully seated within locking feature 130 of the ESL mounting apparatus 100. In this configuration, the top edge of curved lip 126 also engages and presses against the upper ledge 1202 to keep the ESL mounting apparatus 100 firmly in position, unless removed with some significant force.

Figure 15:
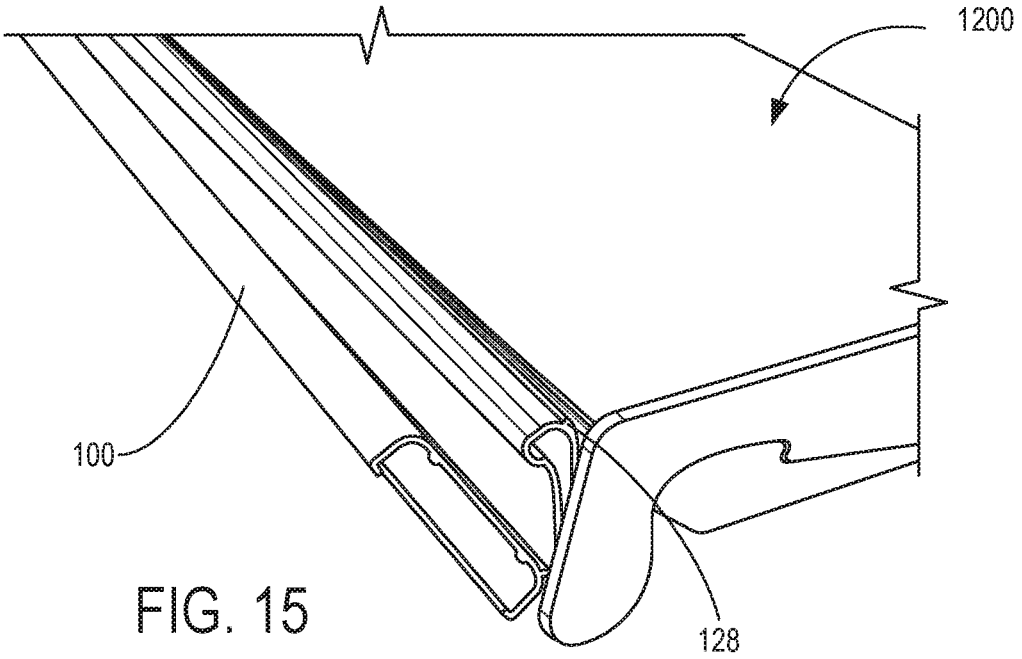
FIG. 15 shows the ESL mounting apparatus of FIGS. 1-7 in an upside-down configuration, and positioned for first and second edges of the installation clip to be snapped into position within the top and bottom ledges of the front C-channel.

Now referring to FIG. 15, shown is the ESL mounting apparatus 100 in an upside-down orientation, and partially installed on the front face of shelving 1200. In this mode, ESL mounting apparatus 100 is snapped into position within the top and bottom ledges 1202, 1204 of the front C-channel of shelving 1200. In this configuration, the outermost tip of lip 127 of installation clip 120 sits in the C-channel contained by the bottom ledge 1204 of the front C-channel of shelving 1200. Also, the first and second grasping members 113, 115 of the rail can grasp a bottom-end and top-end of an ESL 200, respectively, when the ESL mounting apparatus 100 is installed in an upside-down configuration for use on higher shelving.

Figure 16:
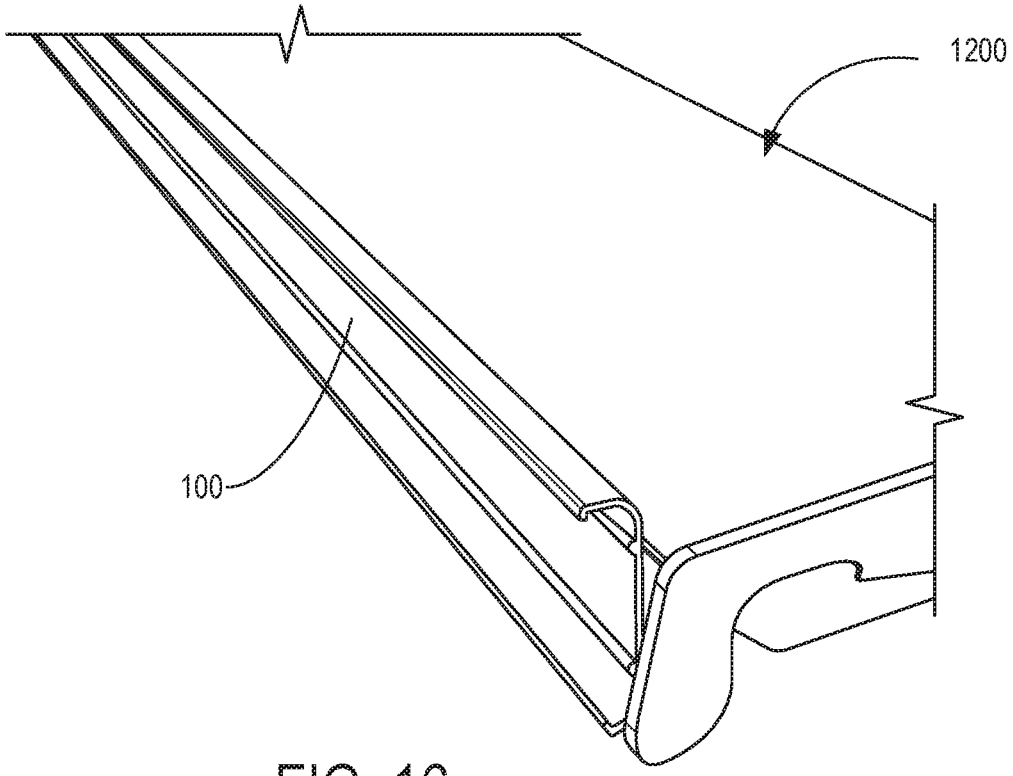
FIG. 16 and shows the ESL mounting apparatus of FIGS. 1-7 being snapped into position within the top and bottom ledges of the front C-channel of the shelving of FIG. 12.

FIG. 16 shows the ESL mounting apparatus 100 being snapped into position within the top and bottom ledges of the front C-channel of the retail shelving of FIG. 12. This is achieved by applying pressure to the rail 110 which will flex toward knee 125 of the installation clip 120. With continued gentle pressure, locking edge 128 of the installation clip 120 will then snap into the C-channel shown in FIG. 12A, and will be contained by the upper ledge 1202 of the front C-channel of shelving 1200.

Figure 17:
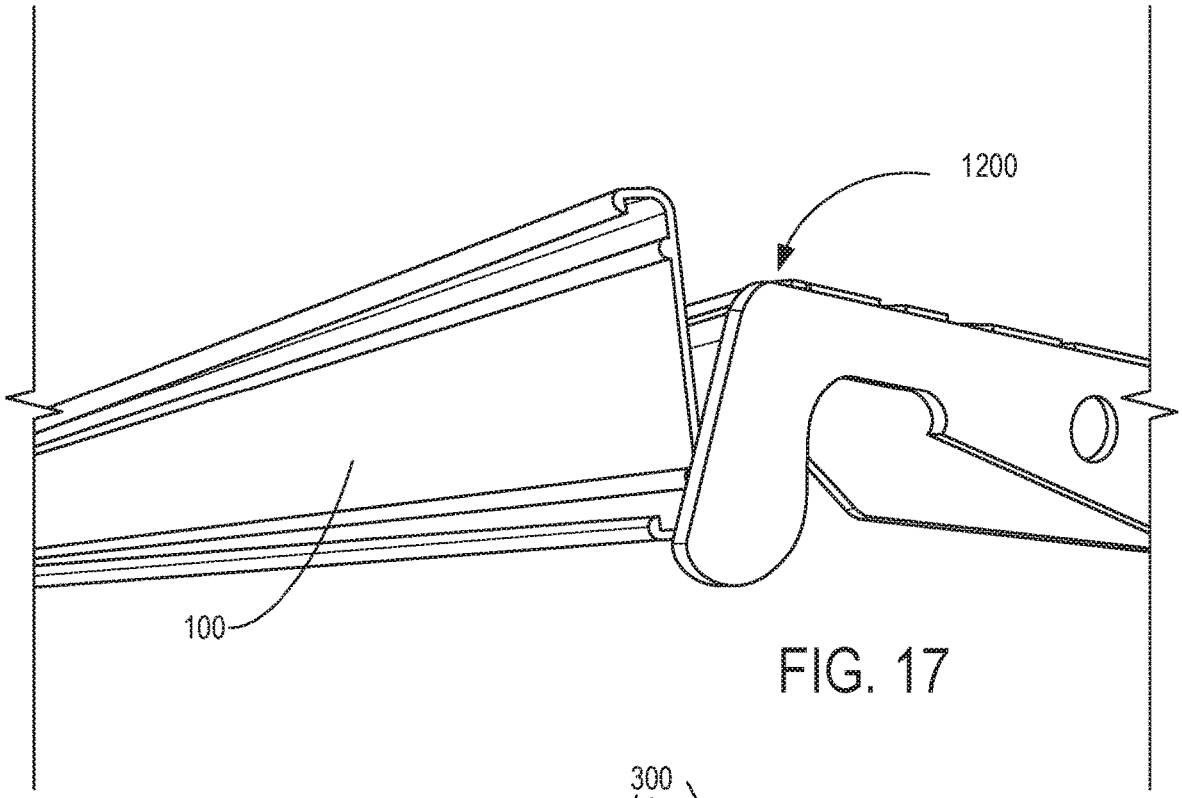
FIG. 17 shows the ESL mounting apparatus of FIGS. 1-7 fully installed into position within the top and bottom ledges of the front C-channel of the shelving of FIG. 12.

FIG. 17 shows the ESL mounting apparatus 100 fully snapped into position within the top and bottom ledges of the front C-channel of the retail shelving of FIG. 12. As shown in FIG. 17, in this upside-down orientation, rail 110 of the ESL mounting apparatus 100 is angled downwardly for better visibility of ESLs mounted within the rail 110.

Figure 18:
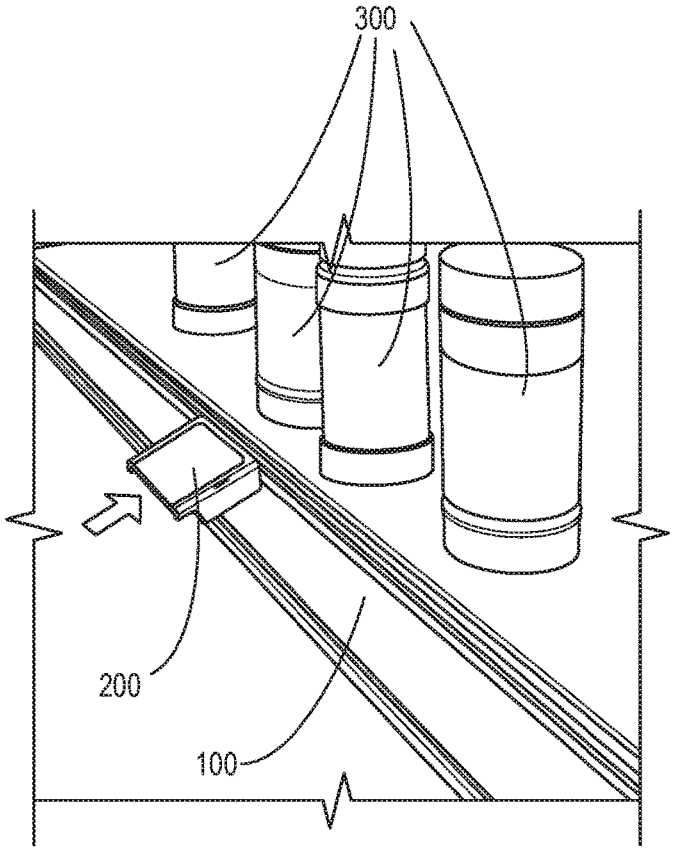
FIG. 18 shows an illustrative ESL being positioned to be mounted within the rail of the ESL mounting apparatus of FIGS. 1-7.

Now referring to FIG. 18, shown is an illustrative ESL 200 being positioned to be mounted within the rail 110 of the ESL mounting apparatus 100.

Figure 19:
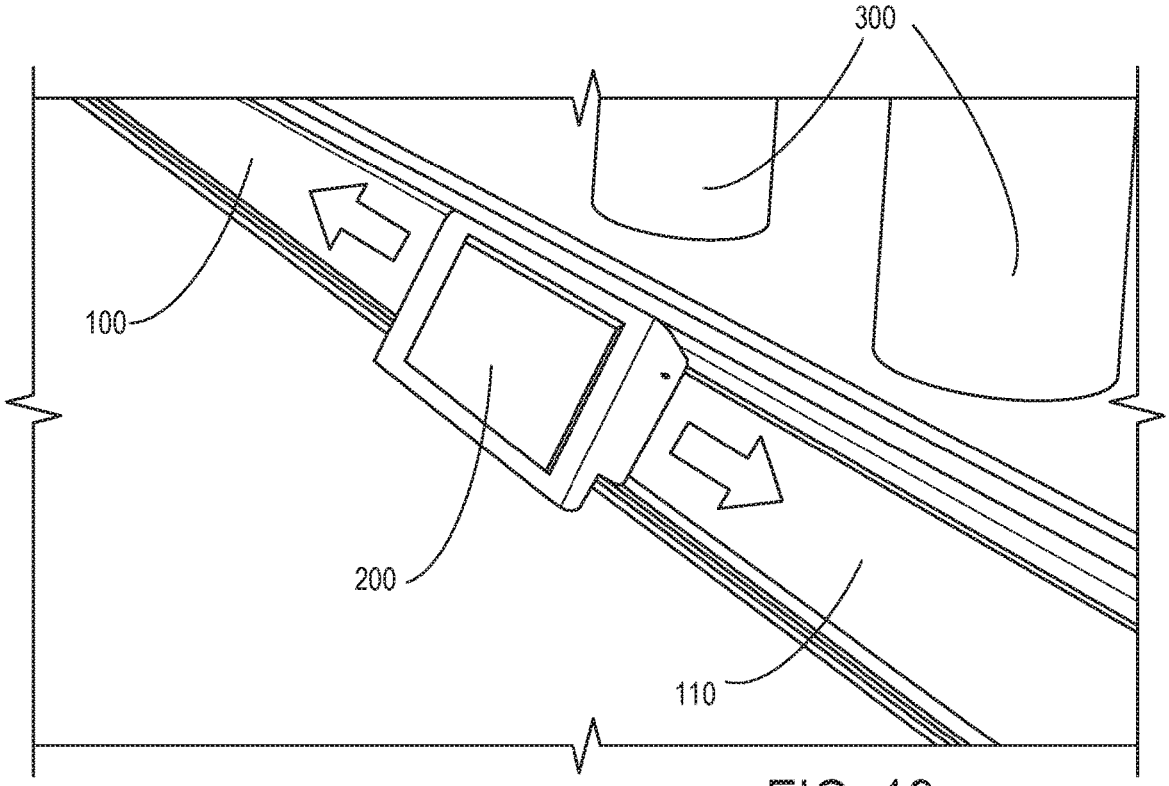
FIG. 19 shows an illustrative ESL mounted within the rail of the ESL mounting apparatus of FIGS. 1-7 and able to be slidably adjusted along the rail in either direction.

FIG. 19 shows an illustrative ESL 200 mounted within the rail 110 of ESL mounting apparatus 100. Once snapped into position, ESL 200 cannot be easily removed without a removal tool, which provides sufficient leverage to lift the first grasping member 113 to allow an ESL 200 to be removed from the rail 110. While ESL 200 is securely held within the rail 110, its position can be slidably adjusted along the rail 110 in either direction, so as to allow ESL 200 to be moved below the corresponding item 300 on the shelving. This allows for great flexibility in stocking and repositioning the items 300.

Figure 20:
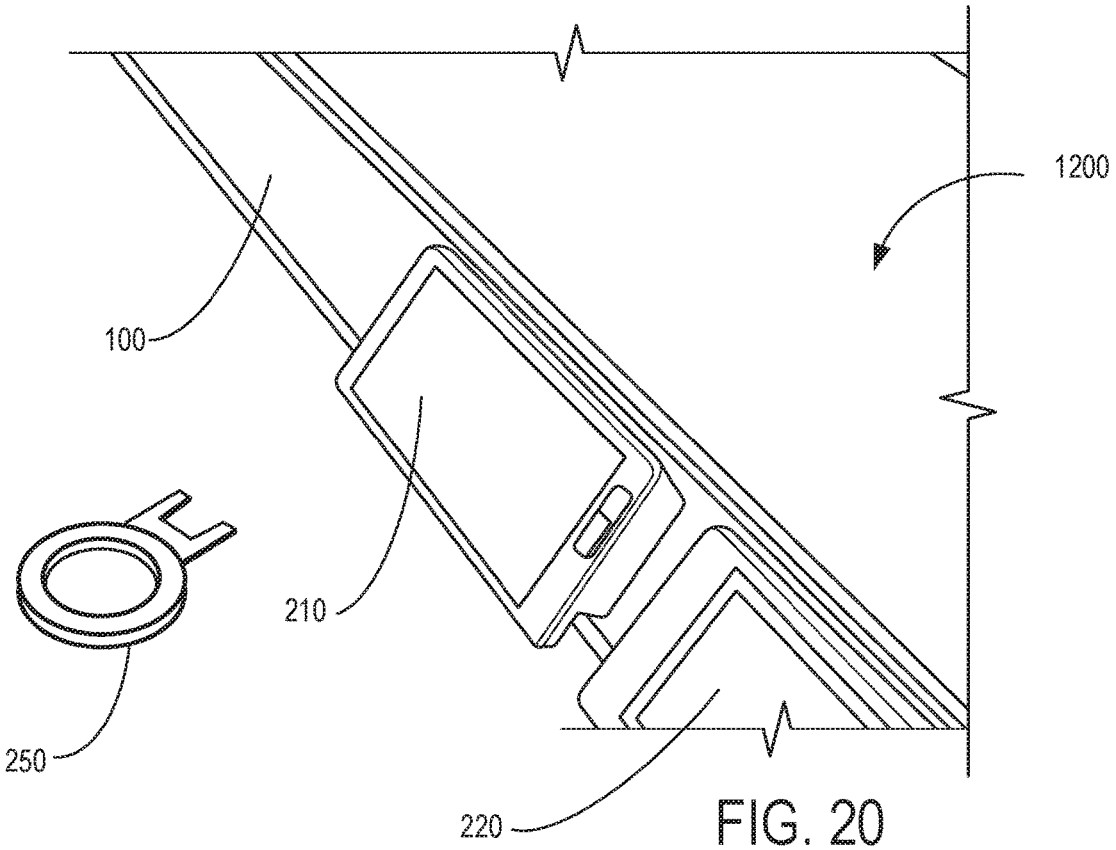
FIG. 20 shows ESLs of different sizes that may also be mounted within the rail of the ESL mounting apparatus of FIGS. 1-7 and able to be slidably adjusted along the rail in either direction.

FIG. 20 shows ESLs 210, 220 of different sizes that may also be mounted within the rail 110 of ESL mounting apparatus 100, and that may also be slidably adjusted along the rail 110 in either direction. Thus, multiple ESLs 200, 210, 220 may be inserted, and removed using a removal tool 250 as required.

Figure 21:
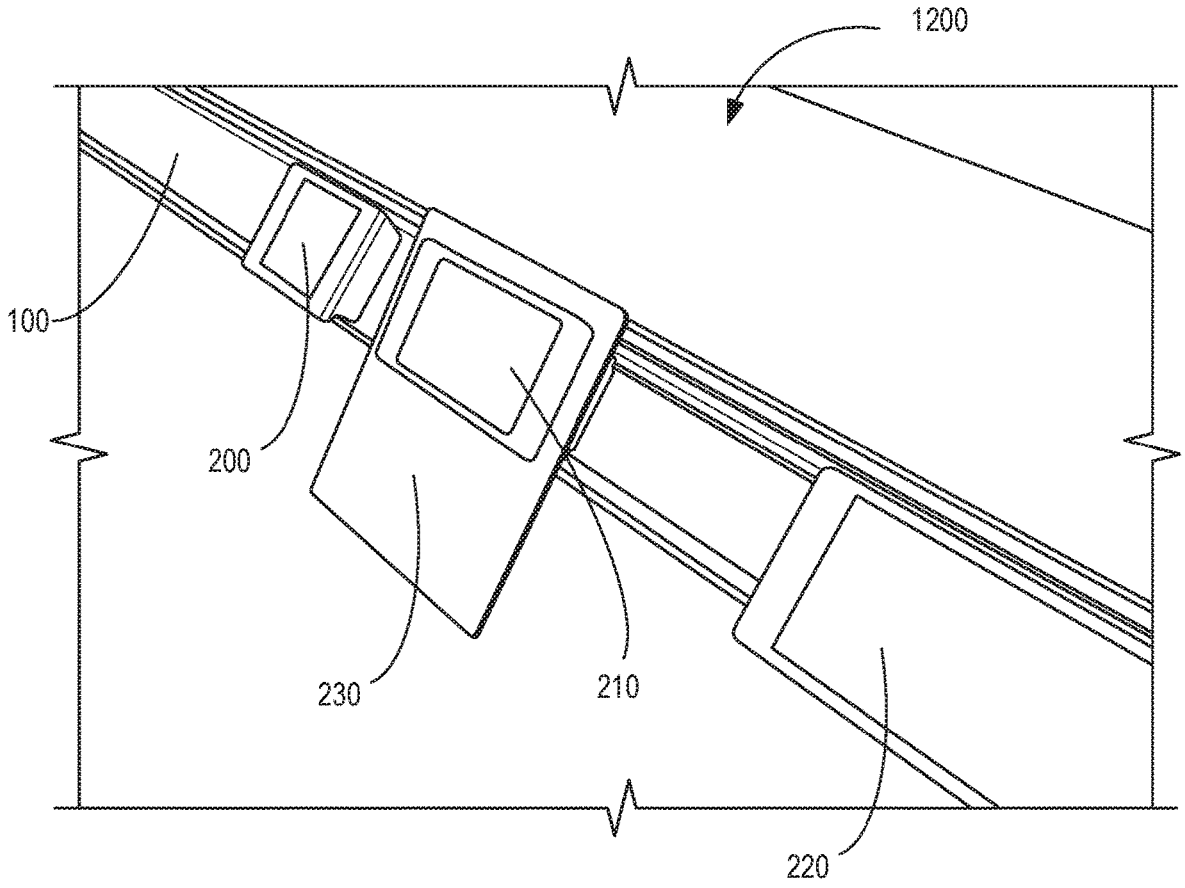
FIG. 21 shows an illustrative ESL having a promotional collar label or "shelf-talker" placed over the ESL to bring it to the attention of a shopper.

FIG. 21 shows an illustrative ESL having a promotional collar or "shelf-talker" 230 placed over the ESL to bring it to the attention of a shopper. In an embodiment, this promotional collar 230 includes legs which slide beneath either side of ESL 210, in the space or gap formed by the first and second protrusions 116, 118 within the rail 110.

Figure 22:
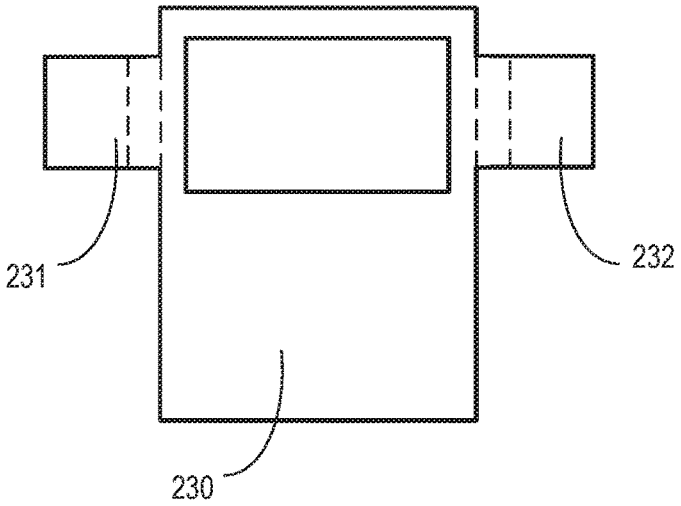
FIG. 22 shows the promotional collar label having foldable legs 231, 232 which may be folded under either side of the ESL on which it is placed.

FIG. 22 shows the promotional collar label 230 of FIG. 21 having foldable legs which may be folded under either side of the ESL on which it is placed.

Advantageously, the ESL mounting apparatus 100 includes a versatile installation clip 120 which allows installation of the ESL mounting apparatus 100 in two orientations. In a first orientation, the installation clip 120 includes an opening 123 to receive a front face of shelving, and to keep the ESL mounting apparatus 100 securely installed on the shelving 800, 1200 as described above. In a second orientation, the outer wall of installation clip 120 includes first and second edges which allow the ESL mounting apparatus 100 to be snapped into position within a C-channel formed by the front face of shelving, thereby providing great flexibility in how the ESL mounting apparatus 100 can be installed on various different types of shelving.

Thus in an aspect, there is provided an apparatus for mounting electronic shelf labels (ESLs) onto shelving, comprising: a rail having first and second grasping members adapted to receive one or more ESLs; and an installation clip integrally connected to the rail, the installation clip adapted to install the apparatus onto shelving in a plurality of configurations by either clipping onto a curved front face of shelving or snapping into a curved front face of shelving.

In an embodiment, the installation clip comprises an inner wall and an outer wall flexibly joined at a knee, the inner and outer walls being resiliently flexible relative to each other and having an opening adapted to receive a front face of shelving therebetween.

In another embodiment, the inner wall and the outer wall of the installation clip further comprise curved lips which curve away from the rail, these curved lips adapted to provide counter pressure against each other when a curved front face of shelving is received therebetween.

In another embodiment, the installation clip further comprises a locking feature to secure a lower ledge of a front face of shelving therein.

In another embodiment, the locking feature comprises an inner pocket shelf for engaging the lower ledge of the front face of shelving.

In another embodiment, the installation clip further comprises a locking feature to at least partially receive a lower curved edge of a front face of shelving therein.

In another embodiment, the locking feature comprises an inner pocket shelf for engaging the lower curved edge of a front face of shelving.

In another embodiment, the installation clip comprises an inner wall and an outer wall flexibly joined at a knee, and the outer wall includes first and second locking edges adapted to engage first and second extending ledges of a front face of shelving when snapped into position.

In another embodiment, the first locking edge is an outermost edge of the outer wall, and the second locking edge is a protrusion formed near a base of the outer wall, the outer wall being resiliently flexible to allow both locking edges to be snapped into position between extending ledges of a front face of shelving.

In another embodiment, the rail is adapted to prevent removal of a mounted ESL without a removal tool.

In another embodiment, the rail is adapted to allow a mounted ESL to be adjusted along its length.

In another embodiment, the rail includes protrusions adapted to provide a space or gap behind a mounted ESL.

In another embodiment, the rail and installation clip are formed as an integral extrusion.

In another embodiment, the rail and installation clip are formed from a plastic.

In another embodiment, the plastic is Polyvinyl chloride (PVC).

In another embodiment, the rail and installation clip are resiliently flexible to allow for manual installation onto shelving and removal.

In another embodiment, the rail and installation clip form an angle to allow the rail to appropriately angle mounted ESLs.

In another embodiment, the angle between the installation clip and the rail is adjustable. While illustrative embodiments have been described above by way of example, it will be appreciated that various changes and modifications may be made without departing from the scope of the invention, which is defined by the following claims.

The invention claimed is:

1. An apparatus for mounting electronic shelf labels (ESLs) onto shelving, comprising:

a rail having first and second grasping members adapted to receive one or more ESLs; and an installation clip integrally connected to the rail, the installation clip adapted to install the apparatus onto shelving by either clipping onto a front face of the shelving or snapping into the front face of the shelving, the installation clip comprising an inner wall and an outer wall flexibly joined at a knee, the inner and outer walls being resiliently flexible relative to each other and having an opening adapted to receive the front face of the shelving therebetween, the inner wall further comprising a first curved lip and the outer wall further comprising a second curved lip, each of the first and second curved lips curving away from the rail, the first and second curved lips at least partially overlapping and adapted to provide counter pressure against each other when the front face of the shelving is received therebetween, the outer wall further comprising a protuberance on a surface thereof facing away from the inner wall, the protuberance spaced from the second curved lip and angled away from the second curved lip, the second curved lip and the protuberance each configured to engage upper and lower extending ledges of the front face of the shelving;

wherein in a first configuration, the front face of the shelving is received within the opening between the inner and outer walls, with the first and second curved lips receiving the the shelving therebetween;

wherein in a second configuration, the apparatus is snapped into the front face of the shelving with the second curved lip engaging the upper extending ledge of the front face of the shelving and the protuberance engaging the lower extending ledge of the front face of the shelving when snapped into position; and wherein in a third configuration, the apparatus is snapped into the front face of the shelving in an upside-down orientation, with the protuberance engaging the upper extending ledge of the front face of the shelving and the second curved lip engaging the lower extending ledge of the front face of the shelving when snapped into position.

2. The apparatus of claim 1, wherein the installation clip further comprises a locking feature to secure a lower ledge of the front face of shelving therein.

3. The apparatus of claim 2, wherein the locking feature comprises an inner pocket shelf for engaging the lower ledge of the front face of shelving.

4. The apparatus of claim 1, wherein the installation clip further comprises a locking feature to at least partially receive a lower curved edge of the front face of the shelving therein.

5. The apparatus of claim 4, wherein the locking feature comprises an inner pocket shelf for engaging the lower curved edge of the front face of the shelving.

6. The apparatus of claim 1, wherein the rail is adapted to prevent removal of a mounted ESL without a removal tool.

7. The apparatus of claim 1, wherein the rail is adapted to allow a mounted ESL to be adjusted along its length.

8. The apparatus of claim 7, wherein the rail includes protrusions adapted to provide a space or gap behind a mounted ESL, the protrusions co-extruded using a softer plastic material to provide greater sliding resistance.

9. The apparatus of claim 1, wherein the rail and installation clip are formed as an integral extrusion.

10. The apparatus of claim 9, wherein the rail and installation clip are formed from a plastic.

11. The apparatus of claim 10, wherein the plastic is Polyvinyl chloride (PVC).

12. The apparatus of claim 10, wherein the rail and installation clip are resiliently flexible to allow for manual installation onto shelving and removal.

* * * * *